US006116428A

United States Patent [19]

Loshe

[11] Patent Number: 6,116,428

[45] Date of Patent: Sep. 12, 2000

[54] FINGER SCREEN DECK ASSEMBLY

[75] Inventor: Dale Loshe, New Haven, Ind.

[73] Assignee: Desiter Machine Company, Inc., Fort Wayne, Ind.

[21] Appl. No.: 09/128,257

[22] Filed: Aug. 3, 1998

[51] Int. Cl.[7] ..... B07B 1/28

[52] U.S. Cl. ..... 209/319; 209/394; 209/395; 24/458

[58] Field of Search ..... 209/314, 319, 209/393, 394, 395; 24/455, 457, 458

[56] References Cited

U.S. PATENT DOCUMENTS

| | | | |
|---|---|---|---|
| 2,775,347 | 12/1956 | Weston . | |
| 3,042,206 | 7/1962 | Olender . | |
| 3,221,877 | 12/1965 | Koning . | |
| 3,241,671 | 3/1966 | Brauchla . | |
| 4,956,078 | 9/1990 | Magerowski et al. | 209/395 X |
| 5,219,078 | 6/1993 | Hadden | 209/315 X |
| 5,322,170 | 6/1994 | Hadden | 209/314 |
| 5,398,815 | 3/1995 | Hadden | 209/319 X |
| 5,614,094 | 3/1997 | Deister et al. | 209/315 X |
| 5,641,071 | 6/1997 | Read et al. | 209/319 |
| 5,769,240 | 6/1998 | Middour et al. | 209/395 X |

FOREIGN PATENT DOCUMENTS

| | | | |
|---|---|---|---|
| 3339605 | 5/1985 | Germany | 209/395 |
| 753490 | 8/1980 | U.S.S.R. | 209/395 |
| 2247850 | 3/1992 | United Kingdom | 209/395 |

OTHER PUBLICATIONS

Sales Brochure for Erin Cascade Heavy Duty Grizzly for top Decks of Reads and Powergrids; no date; 1 page.

Sales Brochure for Erin Cascade Screens; dated 1994; 1 page.

Sales Brochure for Crown Deck Finger Screens—Western Wire Works; dated Nov. 1995; 2 pages.

*Primary Examiner*—Tuan N. Nguyen
*Attorney, Agent, or Firm*—Barnes & Thornburg

[57] ABSTRACT

A deck finger assembly for vibrating screening apparatus which includes a plurality of rod-shaped finger members that are secured in a resilient block that is compressed between a pair of clamping plates. The resilient block includes a plurality of through-holes through which the rod-shaped finger members are inserted. When the pair of clamping plates are drawn together and compress the resilient block, the through-holes in the resilient block contract radially inward and tighten about the rod-shaped finger members. By releasing the clamping plates and the compression force exerted thereby on the resilient block, the rod-like finger members can be removed and replaced as desired.

20 Claims, 4 Drawing Sheets

FINGER SCREEN DECK ASSEMBLY

TECHNICAL FIELD

The present invention relates to material screening apparatus which include screen desks that are formed from a plurality of rods or fingers which are supported at one end. More particularly, the present invention is directed to deck finger assemblies for material screening apparatus which provide for replacement of individual screening rods or fingers.

BACKGROUND ART

Vibrating screening apparatus having deck screens that are supported by frames are known. Generally, the frames have a taller feed end and a shorter discharge end that are joined by two sides. Material to be sized is fed onto an upper shaker screen at the feed end. Material smaller than openings in the upper shaker screen fall therethrough onto a lower vibratory screen. Fines are allowed to pass through openings in the lower vibratory screen, while coarser material is discharged from the lower vibratory screen at the discharge end of the apparatus. Generally, the shaker screens in such apparatus are vibrated by means of off balanced shaft mechanisms which are coupled to the shaker screen assembly.

While the above-described apparatus are efficient for sizing stone, gravel, and other clean aggregate material, such apparatus are inefficient when the feed material comprises a wide variety material such as that found in dumps, which would include sand, soil, rocks, leaves, paper bags, sticks, twigs, cans, bottles, tires, domestic and industrial garbage and trash, and construction site debris. The separation of such materials becomes much more difficult.

There are a number of vibratory screening apparatus that are used to screen disparate feed-type materials in which comb or finger-like members formed of rods define a series of decks over which the feed material is passed. Typically, the screening decks are arranged in a shingle array fashion, with each deck generally horizontally or slightly downwardly tilted from the horizontal and having a plurality of arrays of finger or rod-like members projecting from a transverse frame, so as to provide the desired separation.

In such finger screening devices, the finger members are often mounted so that they can vibrate independently of one another. This independent movement, when the assembly is being vibrated, allows large, heavy clumps of material and other large objects to displace one or more of the finger members and pass through the deck fingers, thereby preventing the apparatus from becoming clogged.

Examples of screening apparatus which use finger members include U.S. Pat. Nos. 5,641,071 to Read et al., 5,398,815 to Hadden, 5,322,170 to Hadden, 5,219,078 to Hadden, 3,241,671 to Brauchla, 3,221,877 to Koning, and 3,042,206 to Olender.

The finger screen devices in use today have finger member assemblies which either include rod-like finger members that are bolted or welded to a traverse support bracket or have rod-like members that are individually clamped in a support block which is in turn supported by a support bracket as depicted, for example, by Erin Screens (Portland Me.) in their Cascade™ system.

Finger members that are rigidly attached to support brackets by mechanical means such as bolts, clips, etc., and those which are welded to support brackets are subject to mechanical failure at their point of attachment. In addition to providing stress points at which mechanical failure of the fingers can occur, assemblies exemplified by Cascade™ which involve the use of individually clamped finger members are also susceptible to becoming loose during operation.

The present invention provides a deck finger assembly which is an improvement over current assemblies.

DISCLOSURE OF THE INVENTION

According to various objects of the present invention which will become apparent as the description thereof proceeds below, the present invention provides a deck finger assembly for a vibrating screening apparatus which includes:

- a plurality of rod-shaped finger members;
- a resilient block that includes a plurality of through-holes for receiving the plurality of rod-shaped finger members;
- a pair of clamping plates between which the resilient block can be compressed; and
- mechanical fasteners coupled to the pair of clamping plates that can be operated to draw the pair of clamping plates together and thereby apply a compression force on the resilient block.

The present invention further provides a vibrating screening apparatus which includes:

- a frame;
- means to vibrate the frame; and
- a plurality of deck finger assemblies each of which includes:
  - a plurality of rod-shaped finger members;
  - a resilient block that includes a plurality of through-holes for receiving the plurality of rod-shaped finger members;
  - a pair of clamping plates between which the resilient block can be compressed; and
  - mechanical fasteners coupled to the pair of clamping plates that can be operated to draw the pair of clamping plates together and thereby apply a compression force on the resilient block.

The present invention also provides a method of securing rod-shaped finger members in a deck finger assembly which involves:

- providing a resilient block that includes a plurality of through-holes;
- positioning the resilient block between a pair of clamping plates which include a plurality of through-holes;
- inserting rod-shaped finger members through the through-holes in the pair of clamping plates and through the through-holes in the resilient block; and
- drawing the pair of clamping plates together to thereby compress the resilient block therebetween.

BRIEF DESCRIPTION OF DRAWINGS

The present invention will be described hereafter with reference to the attached drawings which are given as non-limiting examples only, in which.

BEST MODE FOR CARRYING OUT THE INVENTION

Figure 1:
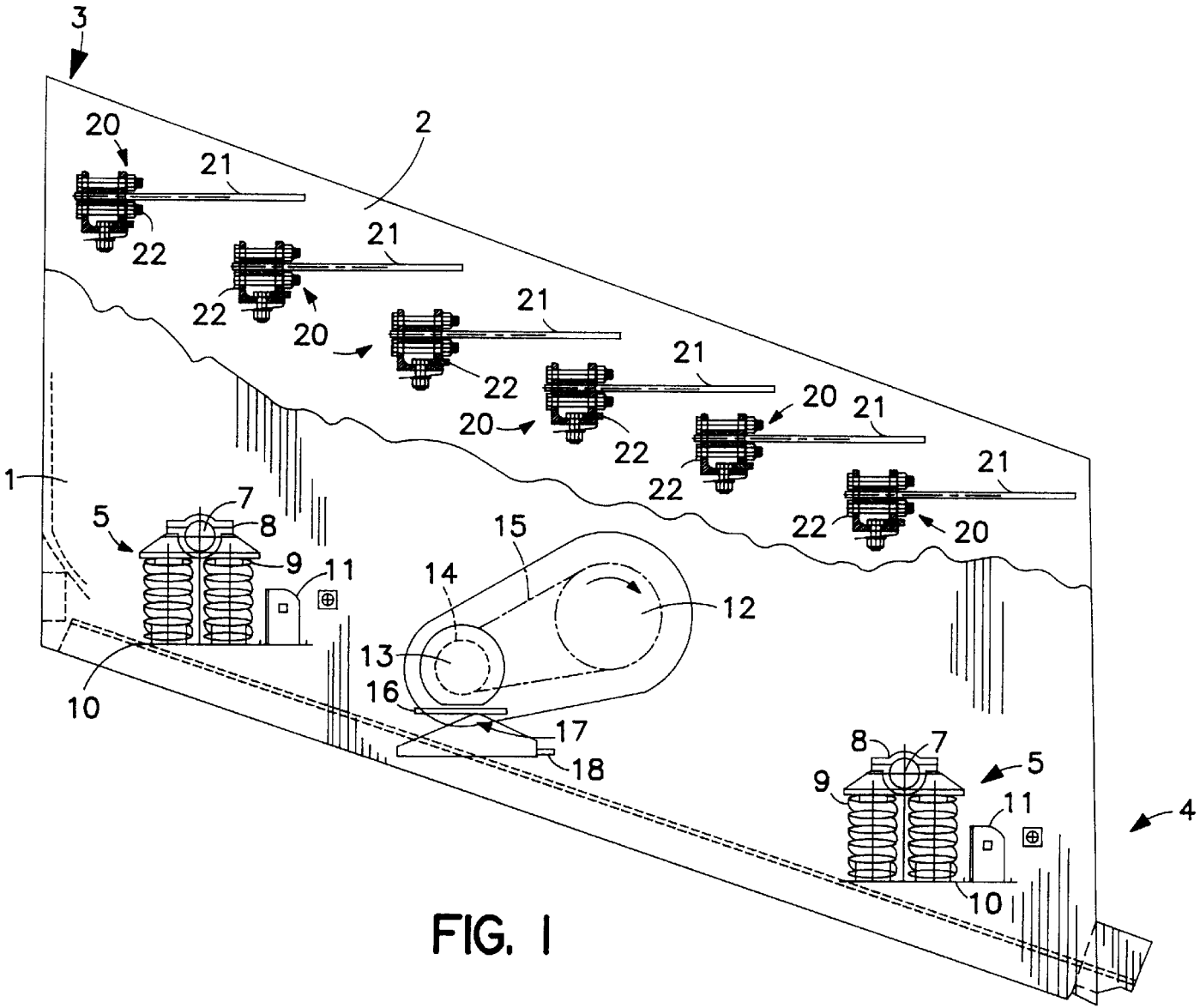
FIG. 1 is a side elevational view of a vibrating screening apparatus according to the present invention with portions broken away for clarity.

The present invention is directed to finger screen deck assemblies and screening apparatus which use the same. The finger screen deck assemblies of the present invention are designed for use with new vibrating screen apparatus or for retrofitting existing vibrating screen decks. The finger screen deck assemblies of the present invention are modular units which can be coupled to the sidewalls of the frame of a vibrating screen apparatus. Otherwise, the deck finger assemblies can be coupled between the sidewalls of a frame and one or more center plates or similar structures which extend across the frame of a vibrating screen apparatus.

The reference herein to a vibrating screen apparatus refers to the use of the finger screen deck assemblies in combination with the type of frame structures that are conventionally used in vibrating screen apparatus. Such apparatus include a frame having opposed sidewalls, a feed end, a discharge end, a deck support, and means to vibrate the deck. The finger screen deck assemblies of the present invention can be used in combination with such vibrating screen structures by replacing the screen decks with the finger screen deck assemblies of the present invention. Accordingly, the finger screen deck assemblies of the present invention can be used to retrofit standard vibrating screen apparatus. This can be achieved by substituting the finger screen deck assemblies of the present invention for the screen decks in conventional vibrating screen apparatus.

The finger screen deck assemblies of the present invention include a plurality of finger members that are supported in a linear array. The finger members are supported at one end thereof by a support assembly. The support assembly supports the finger members in a resilient manner so that they return to their original position or alignment when deflected by a heavy load. The support assembly supports the finger members in a compressed resilient block. The finger members are received in bores of a resilient block which is compressed between a pair of clamping plate members. The compression of the resilient member causes bores in which the finger members are positioned to tighten about and secure the finger members therein. Each of the finger members of finger screen deck assemblies are capable of independent movement with respect to the other finger members, because of the manner in which they are secured by the resilient block. Thus, a heavy, isolated load is able to deflect only a finger member(s) upon which it is supported during a screening operation. Movement of the fingers in response to deflection assists in the movement of material along the finger screen deck and prevents accumulation.

Since the finger members are held in a resilient manner in the support assemblies, stress points at which mechanical failure of the finger members can occur are reduced or eliminated. In addition, the manner in which the finger members are secured in the support assemblies allows one or more of the finger members to be easily removed and replaced.

FIG. 1 is a side elevational view of a vibrating screening apparatus according to the present invention with portions broken away for clarity. The apparatus of FIG. 1 includes a frame formed by a pair of parallel sidewalls 1, 2 with one sidewall 1 shown in a cut away manner. The apparatus includes a feed end 3 at which material to be separated is received by the apparatus, and a discharge end 4 from which material is discharged. The sidewalls 1, 2 are supported on heavy duty coil spring assemblies 5. Such springs assemblies 5 can be coupled to the sidewalls 1, 2 by conventional pivot trunnion assemblies as described in U.S. Pat. No. 5,614,094, or by heavy duty tubes or pipes 7. Such tubes or pipes 7 can be received by pivot brackets 8 which, in turn, are supported by coil spring assemblies that include upper spring seats 9 and base plates 10 that are supported by a support structure in a known manner. The vibration apparatus can also include snubbers 11 as depicted in Fi. 1. The coil spring assemblies isolate the vibration of the apparatus.

The apparatus of FIG. 1 is vibrated by means of a counter-weighted vibrator shaft 12 which is rotated by motor 13. Counter-weighted vibrator shaft 12 includes a sheave 14 which is adapted to accommodate a V-belt 15 which is driven by motor 13. The tension of V-belt 15 can be adjusted by altering the angular position of motor base plate platform 16 about pivot point 17 by spring loaded bolt 18. An alternative arrangement for effecting vibration of the assembly can include the shaft assembly and reversible counter-weight disclosed in U.S. Pat. No. 5,614,094, the complete disclosure of which is hereby expressly incorporated by reference. In general, any conventional means to vibrate the screen deck can be used in conjunction with the present invention.

A plurality of finger screen deck assemblies 20 are provided between the sidewalls 1, 2 so that the finger members 21 thereof are arranged in a tiered manner along the length of the apparatus. Each finger screen deck assembly 20 includes an array of finger members 21 that extend from a support assembly 22. As depicted, the finger screen deck assemblies 20 are positioned so that the free ends of each array of finger members 21 overlap the fixed ends of a lower, adjacent array of finger members 21. In this manner, the tiered arrays of finger members 21 define a finger screen deck along which material to be separated can be transported in a cascading manner as the deck is vibrated. The finger members 21 can be arranged so that their free ends are angled slightly downward, e.g. about 20° from horizontal. Such an angled alignment will assist the transportation of material along the finger screen assemblies 20.

Figure 2:
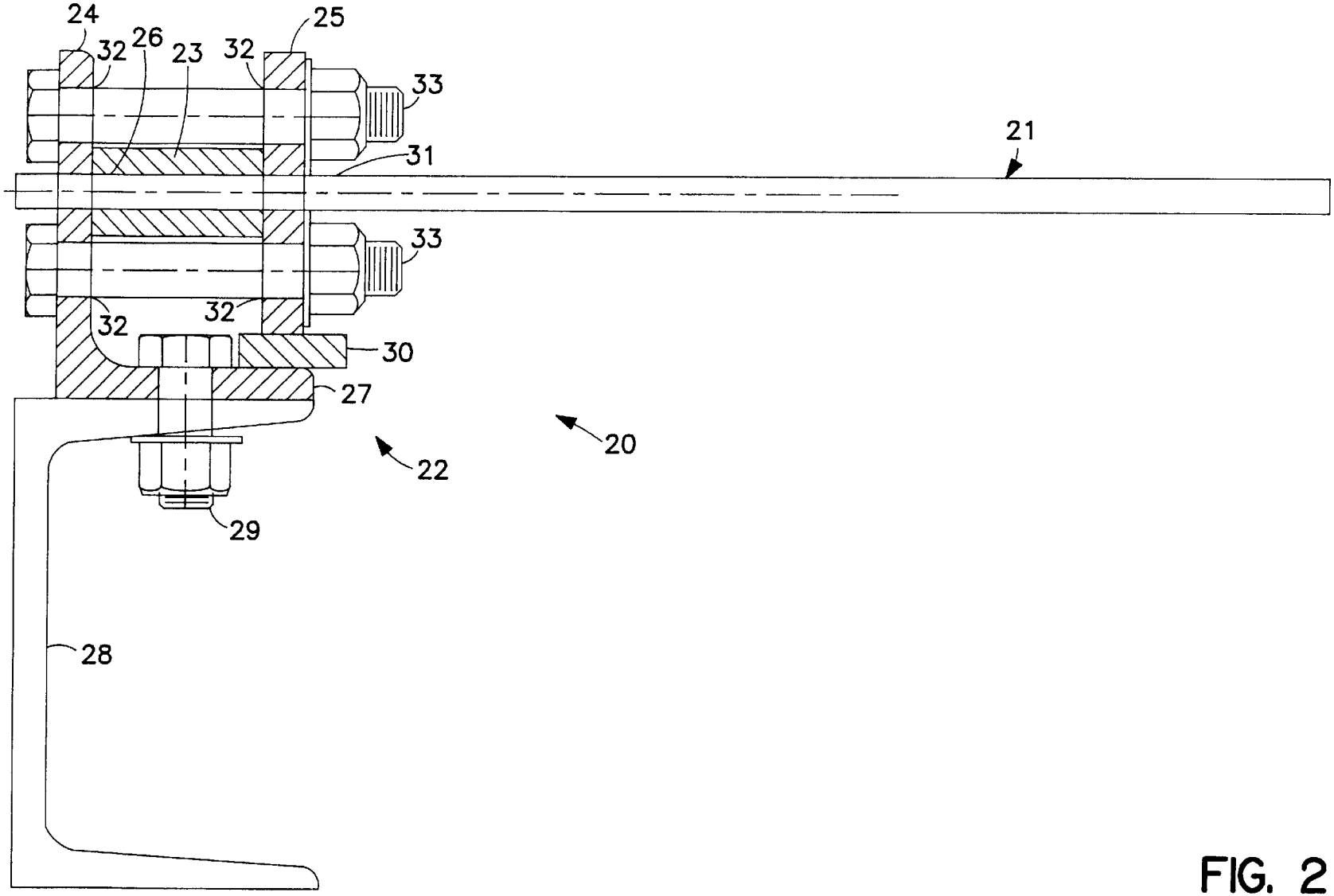
FIG. 2 is a cross-sectional view of a finger screen deck assembly according to one embodiment of the present invention.

FIG. 2 is a cross-sectional view of a finger screen deck assembly according to one embodiment of the present invention. The deck finger assembly 20 includes a plurality of finger members 21 that are supported at one end thereof by a support assembly 22. The support assembly 22 includes a resilient block 23 which can be compressed between a pair of clamping plate members 24, 25. The resilient block 23 includes an array of through-holes 26 which are sized to receive ends of the finger members 21 when the resilient block 23 is not compressed between the pair of clamping plate members 24, 25. Once the resilient block 23 is compressed between the pair of clamping plate members 24, 25 the through-holes 26 contract radially inward, thereby gripping the inserted ends of the finger members 21.

At least one of the pair of clamping plate members includes a portion 27 by which the support assembly 22 can be coupled to a bracket 28. Bracket 28 in turn can be coupled transversely between the sidewalls 1, 2 of the apparatus frame in a known manner by end brackets or other connecting structure. Alternatively, bracket 28 can be connected between a sidewall of the apparatus frame and one or more center plates or similar structures which extend across the frame of the vibrating screen apparatus.

In the embodiment of the support assembly depicted in FIG. 2 clamping plate 24 includes a leg portion 27 which can be coupled to bracket 28 by mechanical fasteners 29. Although FIG. 2 depicts a single mechanical fastener 29, it is understood that a plurality of mechanical fasteners 29, as needed to secure clamping plate member 24 to bracket 28, can be spaced apart along leg portion 27. FIG. 2 also depicts a slide plate 30 or guide which is positioned between clamping plate member 25 and the leg portion 27 of clamping plate member 24. Such a slide plate 30 can be included and attached either to the lower portion of clamping plate member 25 or the leading edge of the leg portion 27 and used to guide and align clamping plate member 25 as it is drawn toward clamping plate member 24, when the resilient block 23 is clamped between the pair of clamping plate members 24, 25.

The pair of clamping plate members 24, 25 include an array of aligned through-holes 31 which are aligned with the through-holes 26 in resilient block 23. The through-holes 31 in clamping plate 25 can be slightly larger than the through-holes 31 in clamping plate 24 so as to allow for some movement, e.g. deflection, of the finger members 21. In addition to through-holes 31, the pair of clamping plate members 24, 25 also include staggered, spaced apart through-holes 32 which are aligned to receive mechanical fasteners 33 that are used to draw the pair of clamping plate members 24, 25 together and clamp and compress the resilient block 23 therebetween. In alternative embodiments, the mechanical fasteners 33 could be replaced with a clamping mechanism that does not include fasteners which extend through the resilient member. For example, a clamping mechanism could be used which has mechanical fasteners that pass on either side of the resilient block or clamping plates 24 and 25. Although FIG. 2 depicts the fixed end of the finger members 21 as extending beyond clamping plate 24, it is to be understood that the finger members 21 merely need to extend into through-hole 31 of clamping plate 24. FIG. 2 depicts a small abutment near the fixed end of the finger members 21. Such an abutment or a stepped, bent or flange portion can be used to abut clamping plate 24 when the finger members 21 are inserted through through-hole 31 therein, and thereby properly align the lengths of the finger members 21 with the support assembly 22.

Figure 3:
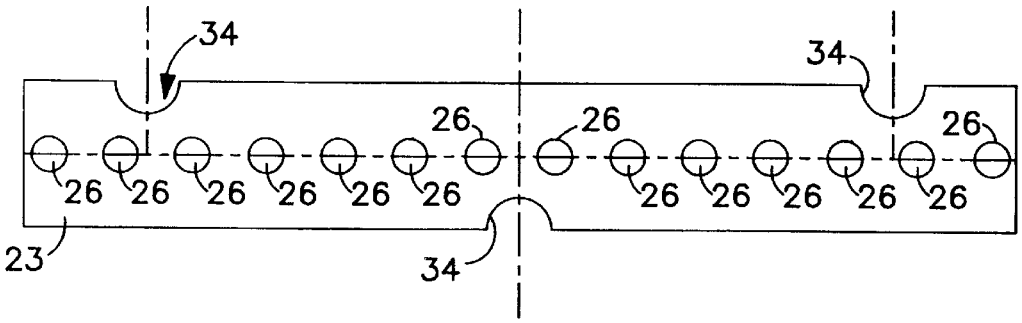
FIG. 3 is a front elevational view of an resilient block according to one embodiment of the present invention.
Figure 4:
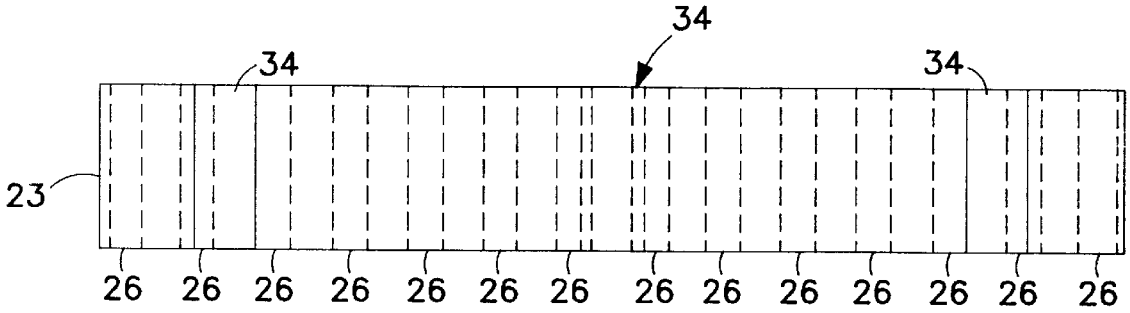
FIG. 4 is a top planar view of the resilient block of FIG. 3.
Figure 5:
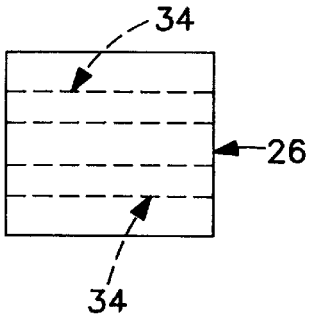
FIG. 5 is a side elevational view of the resilient block of FIG. 3.

FIG. 3 is a front elevational view of an resilient block according to one embodiment of the present invention. FIG. 4 is a top planar view of the resilient block of FIG. 3. FIG. 5 is a side elevational view of the resilient block of FIG. 3. The embodiment of the resilient block depicted in FIGS. 3–5 includes an elongated body that has a rectangular cross-section. A linear array of through-holes 26 is provided along or near the center of the resilient block 23 as depicted in FIG. 3. These through-holes 26 extend through the resilient block 23 and are sized to receive ends of finger members 21. The inside diameters of the through-holes 26 should be slightly larger than the outside diameters of the finger members 21 so that the finger members 21 are easily received in the through-holes 26 of an uncompressed resilient member 23.

As depicted in FIG. 2 and discussed above, the pair of clamping plate members 24, 25 are coupled together by mechanical fasteners 33 which are used to draw the clamping plate members 24, 25 together and compress the resilient member 23 therebetween. As shown in FIG. 3, the resilient block 23 includes a plurality of cut-out or notched portions 34 which provide clearance for the mechanical fasteners 33 shown in FIG. 2. The cut-out or notched portions depicted in FIG. 2 indicate that three mechanical fasteners 33 can be used in a spaced apart, staggered manner.

The resilient block 23 can be made of rubber or a similar resilient elastomeric or polymeric material that can be compressed.

Figure 6:
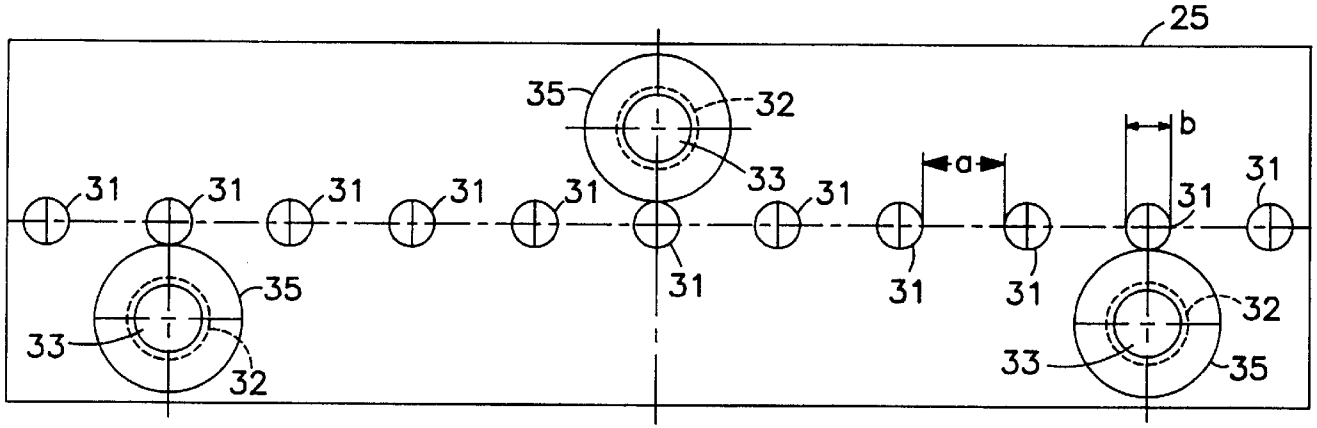
FIG. 6 is a front elevational view of a clamping plate according to one embodiment of the present invention.

FIG. 6 is an front elevational view of a clamping plate according to one embodiment of the present invention. The clamping plate 25 depicted in FIG. 6 includes a plurality of through-holes 31 that are depicted as being aligned in a linear array along or near the center of the clamping plate 25. The spacing between the through-holes 31 represented by distance "a" in FIG. 6 can be varied to achieve a desired separation. For example, it has been determined that this spacing can range from 0.5 inches to 1.0 inches according to one embodiment of the invention in which the diameter "b" of through-holes 31 was 0.375 inches. It is noted that these dimensions can vary depending on the material to be processed. Although through-holes 31 are depicted as being equally spaced apart, it is possible to vary the spacing between the through-holes, if desired. It is noted that clamping plate 24 would be provided with similarly sized and aligned through-holes 31.

The clamping plate 25 includes a plurality of through-holes 32 which are provided to receive mechanical fasteners 33. FIG. 6 depicts washers 35 which are positioned around mechanical fasteners 33. Through-holes 32 are staggered on either side of the array of through-holes 31 as depicted. This staggered alignment provides uniform clamping with a minimum number of mechanical fasteners 33. It is possible to use more mechanical fasteners 33 to draw clamping plates 24 and 25 together, and thus include more through-holes 32.

Figure 7B:
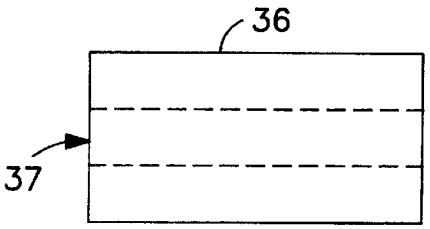
FIGS. 7*a* and 7*b* are end and side views of an alternative resilient block according to another embodiment of the present invention.
Figure 7A:
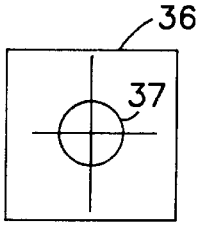

FIGS. 7*a* and 7*b* are end and side views of an alternative resilient block according to another embodiment of the present invention. The resilient block 36 of FIGS. 7*a* and 7*b* comprises a rectangular block having a square cross-section. A through-hole 37 extends through the axial center of the resilient block as depicted. The resilient block 36 of FIGS. 7*a* and 7*b* is designed to receive a single rod or finger 21. Similar resilient blocks that receive two or more rod or finger members 21 can be used in conjunction with the clamping plates 24 and 25 of the present invention.

The deck finger assembly of FIG. 2 can be assembled by inserting the finger members 21 though the through-holes 31 in the clamping plates 24 and 25 and through the through-holes 26 in resilient block 23 so that the resilient block 23 is positioned between clamping plates 24 and 25. Next, mechanical fasteners 33 are inserted through the aligned through-holes 32 in clamping plates 24 and 25. As the mechanical fasteners are tightened against clamping plates 24 and 25, the clamping plates draw together and exert a compression force on the resilient block 23. This compression force causes the through-holes 31 in resilient block 32 to tighten about and secure the finger members 21 therein. The resulting finger deck 21 assembly can be coupled to a bracket 28 which can in turn can be coupled transversely between the sidewalls of a vibrating screen apparatus frame in a known manner by end brackets or other connecting structure. Alternatively, bracket 28 can be connected between a sidewall of the apparatus frame and one or more center plates or similar structures which extend across the frame of a vibrating screen apparatus.

Individual finger members 21 can be replaced by loosening mechanical fasteners 33 and relieving the compression force applied to resilient block 23 by clamping plates 24 and 25. Once the compression force is relieved, the diameter of the through-holes 26 expand, thus releasing the finger members 21. In this state, one or more of the finger members 21 can be removed and replaced as desired. Thereafter, the mechanical fasteners 33 can be tightened to compress resilient block 23.

As can be understood from the above description, the finger deck assemblies 20 of the present invention allow for easy removal and replacement of individual finger members 21. Thus, if one or more finger members 21 suffer mechanical failure, the vibrating screening apparatus can be easily repaired without extensive effort or downtime. Moreover, because individual finger members 21 can be easily removed and replaced as opposed to removing and replacing a complete finger deck assembly, the present invention offers significant costs savings over prior art devices. In addition, because the finger members 21 are held in a resilient manner in the support assemblies, stress points at which mechanical failure of the finger members 21 can occur are reduced or eliminated.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A deck finger assembly for a vibrating screening apparatus which comprises:

a plurality of rod-shaped finger members;

a resilient block that includes a plurality of through-holes extending through opposite sides thereof for receiving the plurality of rod-shaped finger members;

a pair of clamping plates located on the opposite sides of the resilient block between which pair of clamping plates the resilient block can be compressed; and mechanical fasteners coupled to the pair of clamping plates that can be operated to draw the pair of clamping plates together and thereby apply a compression force on the resilient block.

2. A deck finger assembly for a vibrating screening apparatus according to claim 1, wherein one of said pair of clamping plates includes a portion by which the deck finger assembly can be coupled to a support bracket.

3. A deck finger assembly for a vibrating screening apparatus according to claim 1, wherein the mechanical fasteners extend beyond the pair of clamping plates.

4. A deck finger assembly for a vibrating screening apparatus according to claim 3, wherein the mechanical fasteners extend through each of the pair of clamping plates.

5. A deck finger assembly for a vibrating screening apparatus according to claim 4, wherein the mechanical fasteners extend through the resilient block.

6. A deck finger assembly for a vibrating screening apparatus according to claim 1, wherein the resilient block comprises a plurality of resilient block members each of which includes at least one through-hole.

7. A deck finger assembly for a vibrating screening apparatus according to claim 1, further comprising a guide which aligns the pair of clamping plates.

8. A vibrating screening apparatus which comprises:

a frame;

means to vibrate the frame; and a plurality of deck finger assemblies each of which includes:

a plurality of rod-shaped finger members;

a resilient block that includes a plurality of through-holes extending through opposite sides thereof for receiving the plurality of rod-shaped finger members;

a pair of clamping plates located on the opposite sides of the resilient block between which pair of clamping plates the resilient block can be compressed; and mechanical fasteners coupled to the pair of clamping plates that can be operated to draw the pair of clamping plates together and thereby apply a compression force on the resilient block.

9. A vibrating screening apparatus according to claim 8, wherein one of the pair of clamping plates of each deck finger assembly includes a portion by which the deck finger assembly can be coupled to a support bracket.

10. A vibrating screening apparatus according to claim 9, further including a plurality of support brackets by which the plurality of deck finger assemblies are coupled to the frame.

11. A vibrating screening apparatus according to claim 8, wherein the mechanical fasteners of each deck finger assembly extend beyond the pair of clamping plates thereof.

12. A vibrating screening apparatus according to claim 11, wherein the mechanical fasteners of each deck finger assembly extend through each of the pair of clamping plates thereof.

13. A vibrating screening apparatus according to claim 12, wherein the mechanical fasteners of each deck finger assembly extend through the resilient block thereof.

14. A vibrating screening apparatus according to claim 8, wherein the resilient block of each deck finger assembly comprises a plurality of resilient block members each of which includes at least one through-hole.

15. A vibrating screening apparatus according to claim 8, wherein each deck finger assembly further comprises a guide which aligns the pair of clamping plates thereof.

16. A method of securing rod-shaped finger members in a deck finger assembly which comprises:

providing a resilient block that includes a plurality of through-holes extending through opposite sides thereof;

positioning the resilient block between a pair of clamping plates so that the clamping plate are on the opposite sides of the resilient block, the pair of clamping plate including a plurality of through-holes;

inserting rod-shaped finger members through the through-holes in the pair of clamping plates and through the through-holes in the resilient block; and drawing the pair of clamping plates together to thereby compress the resilient block therebetween.

17. A method of securing rod-shaped finger members in a deck finger assembly according to claim 16, wherein the pair of clamping plates are drawn together by tightening mechanical fasteners which are coupled thereto.

18. A method of securing rod-shaped finger members in a deck finger assembly according to claim 16, further comprising coupling the deck finger assembly to a support bracket.

19. A method of securing rod-shaped finger members in a deck finger assembly according to claim 18, further comprising coupling the support bracket to the frame of a vibrating screening apparatus.

20. A method of securing rod-shaped finger members in a deck finger assembly according to claim 16 wherein a plurality of resilient blocks are provided with each resilient block having at least one through-hole therein.

* * * * *